US005592699A

United States Patent [19]

Jensen

[11] Patent Number: 5,592,699

[45] Date of Patent: Jan. 14, 1997

[54] DEVICE FOR A URINAL USED BY BEDRIDDEN PATIENTS

[76] Inventor: Niels Jensen, Ræveskovsvej 5, Gentofte, Denmark, 2820

[21] Appl. No.: 381,077

[22] Filed: Jan. 31, 1995

[51] Int. Cl.[6] ..... A47K 11/12

[52] U.S. Cl. ..... 4/144.3; 4/144.1; 141/285; 141/390

[58] Field of Search ..... 4/144.1, 144.2, 4/144.3, 144.4, 267, 281, 282, 283, 450, 454, 456, 457, 474, 475, 481, 482, 483, 285, 479; 141/285, 301, 390, 391

[56] References Cited

U.S. PATENT DOCUMENTS

| | | | |
|---|---|---|---|
| 703,844 | 7/1902 | Yochum | 4/281 |
| 1,574,259 | 2/1926 | Sarff | 4/285 X |
| 2,985,888 | 5/1961 | Whelan | 4/456 |
| 3,025,531 | 3/1962 | Baker | 4/450 |
| 3,913,639 | 10/1975 | Davis | 141/285 |
| 4,059,124 | 11/1977 | Hill | 4/144.2 X |
| 4,569,090 | 2/1986 | Muller | 4/144.2 |
| 5,406,650 | 4/1995 | Einbinder | 4/144.2 |

FOREIGN PATENT DOCUMENTS

| | | | |
|---|---|---|---|
| 0338158 | 5/1904 | France | 4/144.1 |
| 2948393 | 6/1981 | Germany | 4/454 |
| 1171263 | 11/1969 | United Kingdom | 4/144.1 |
| 2199742 | 7/1988 | United Kingdom | 4/144.1 |

*Primary Examiner*—Robert M. Fetsuga
*Attorney, Agent, or Firm*—Dick and Harris

[57] ABSTRACT

A mouth piece (2) for a urinal (1) comprises a round part (6) to sealingly contact the mouth (3) of the urinal. Furthermore, the mouth piece comprises a liquid barrier or bridge (14) across the round part, said bridge separating the opening into two areas, the bottom one being closed off by a floor are (9) with a valve (10, 11) only permitting the flow of urine into the urinal.

The resulting urinal for bedridden patients can be used by men and women alike and is provided such that urine cannot run out of the urinal during and after use.

6 Claims, 1 Drawing Sheet

DEVICE FOR A URINAL USED BY BEDRIDDEN PATIENTS

FIELD OF THE INVENTION

The invention relates to a device for a urinal used by bedridden patients and comprising a mouth piece provided to be attached to the mouth of the urinal.

DESCRIPTION OF THE PRIOR ART

Only a few of the existing urinals are suitable for bedridden patients. Moreover, they are predominantly made for male patients only.

It is not easy to develop and use a urinal for bedridden female patients, as it is difficult to secure sealing contact between urinal and patient. Furthermore, it is difficult to provide a urinal or mouthpiece of the type where the content of the urinal does not spill into the bed.

DISCLOSURE OF THE INVENTION

The object of the invention is to provide a mouth piece for an all-purpose urinal particularly suitable for bedridden patients. By providing a device for a urinal used by bedridden patients in the form of a mouth piece to be attached to the mouth of the urinal, wherein the mouth piece comprises a round part provided to get into sealing contact with the mouth of the urinal, a liquid barrier or bridge extending substantially across the round part thereby separating an opening of the round part into two areas, one of which is closed off by a floor area that includes a valve only permitting flow of liquid into the urinal when the device is attached to the urinal the following objects are achieved: The urinal can be used by men as well as women, the content of the urinal does not spill into the bed and the mouth piece does neither impede nor block the procedure of emptying the urinal after use.

The device is separated into two areas by means of a liquid barrier or bridge, the top area, which is open, being used by men, the bottom area being used by women, said top area also being used when emptying the urinal.

A mouth piece having a purchase, flap, tab or the like provides a bottom area narrowing funnel-like towards the opening of the valve so that urine flows freely towards the opening of the valve and then into the urinal. The valve prevents any backflow of urine through the valve and into the bed.

The entire mouth piece including a round part with a border area, a liquid barrier or bridge, a holding means for a valve ball as well as a purchase, flap, tab or the like forms an integral unit of plastic and provides a simple, but workable non-return valve, the valve ball of which being easily removable for cleaning purposes etc. The valve ball is the only mobile part and the only additional park necessary when the entire mouth piece including the round part with the border area, the liquid barrier or bridge, the holding means for the valve ball as well as the purchase, flap, tab or the like forms an integral unit made of plastic.

A mouth piece wherein a border area comprises an outwardly projecting, round beaded area sealingly contacting an outwardly projecting, round rim of the urinal provides improved sealing contact with respect to the patient without inconveniencing the latter. When a mouth piece wherein the floor area is lower than the border of the round part is used, the inconvenience caused is reduced to a minimum.

The mouth piece is provided with a purchase, flap, tab or the like and is easily removed from the urinal, eg. for cleaning or exchanging purposes.

In the preferred embodiment, the entire mouth piece including a round part with a border area, a liquid barrier or bridge, holding means for a valve ball as well as a purchase, flap, tab or the like forms an integral unit made of plastic. In this embodiment production costs are considerably reduced, while simultaneously providing a simple, robust device. The production costs of this embodiment of the inventive mouthpiece can be reduced to such an amount that the device is a suitable disposable item.

Finally, an inventive mouthpiece comprises an outwardly projecting, round beaded area sealingly contacting an outwardly projecting, round rim of the urinal which ensures sealing contact between the urinal and the said mouthpiece, while the latter is easily removed and/or exchanged.

BRIEF DESCRIPTION OF THE DRAWING

The invention is described in greater detail below and with reference to the accompanying drawing, which shows a urinal with a device according to the invention partially in a cross-sectional, partially in a perspective view.

DETAILED DESCRIPTION OF THE PREFERRED EMBODIMENT

Figure 1:
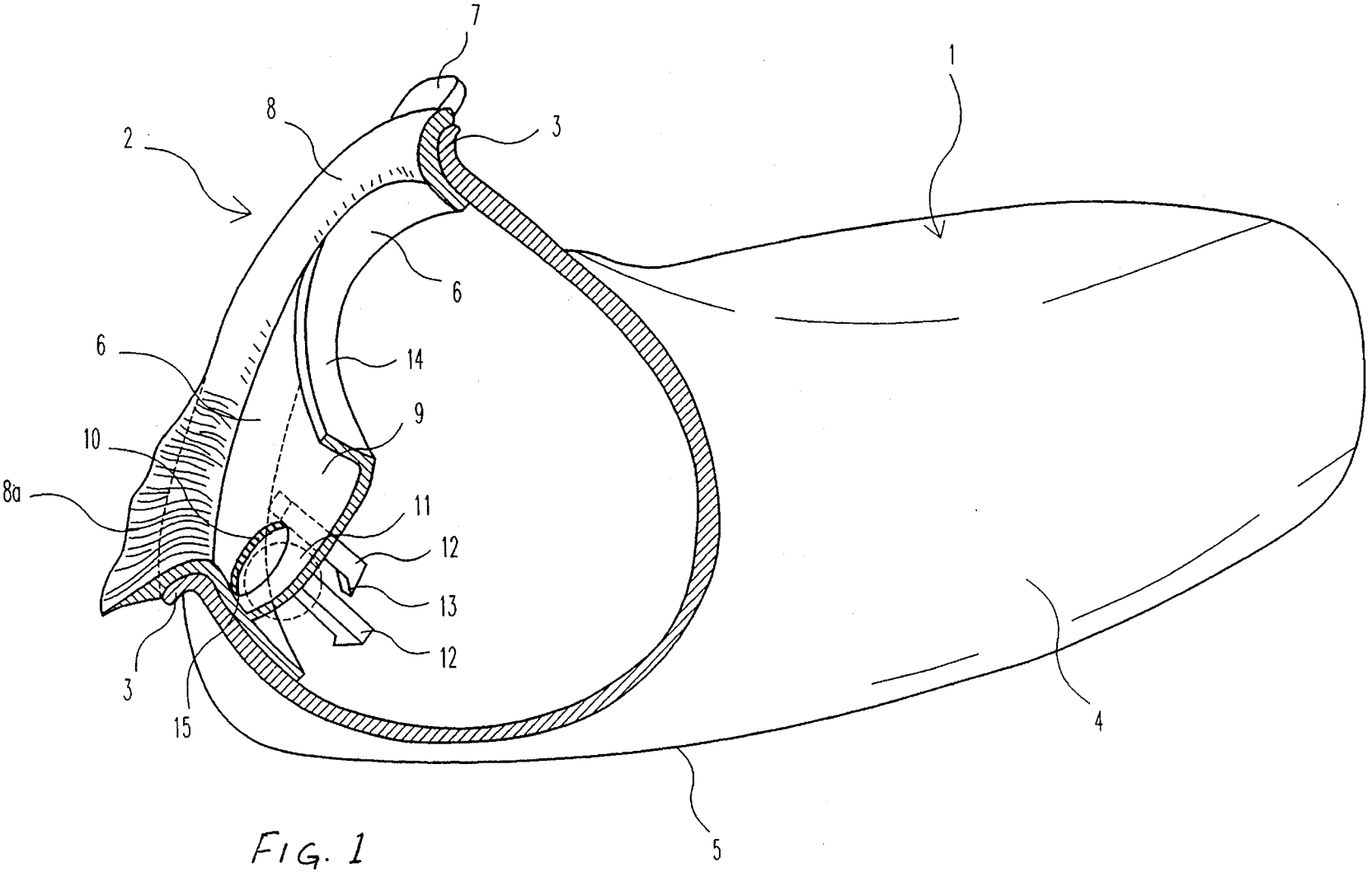

The drawing shows a preferred embodiment of the invention. A urinal 1 made of glass or plastics with a chamber or receiving vessel 4 and a substantially planar bottom 5 is provided with a mouth delimited by a rim 3, the rounded edge of said rim projecting outward. A mouth piece 2 is attached to the rim of the urinal, said mouth piece preferably being an injection-moulded, integral unit of soft plastics. This ensures a suitable elasticity necessary to achieve the completely sealing contact at the rim 3 of the urinal 1 and a sensation of comfort for the patient. The general shape of the mouth piece which has to correspond exactly to the shape of the urinal's mouth in order to achieve the desired sealing contact is rounded in an upward direction, eg. in the fore of a circular arc. The mouth piece is substantially drop-shaped, the narrow end pointing downward (during normal use) thus corresponding to the patient's anatomy.

The inventive mouth piece 2 is preferably used for bedridden patients. Therefore it is shown and described in connection with a urinal 1 with a substantially planar bottom 5, so that the urinal can be reasonably securely positioned in a bed. To those skilled in the art it is obvious that the inventive mouth piece can also be used in connection with other types of urinals.

The mouth piece 2 comprises a round part 6 surrounding and resting against the mouth of the urinal. A beaded area 8 extends from the ring-shaped part 6 like a collar, said area resting sealingly against the rim 3 of the urinal.

Across the mouth piece there is a liquid barrier or bridge 14 separating the mouth piece into two areas, a top and a bottom area. The top area is an opening, which may be round, optionally circular, to be used when a man urinates or when the urinal is emptied. The bottom area to be used when a bedridden female patient urinates is described in greater detail below. The liquid barrier or bridge 14 also reinforces the mouth piece in a transverse direction, thus contributing to the sealing contact at the rim of the urinal.

The bottom area is closed off by means of a lower floor area 9 forming an integral unit with the rest of the mouth piece. The floor area 9, the liquid barrier or bridge 14 and the round, surrounding part 6 form a funnel towards an opening 10 which is part of a non-return valve, the latter ensuring that liquid can only pass from the funnel area into the urinal, but not back. The valve comprises a valve seat 15 provided by the bottom side of the opening's 10 border and a valve ball 11, preferably a hollow ball made of plastics retained by a plurality of elastic plastic holders 12 with projections 13, said holders and projections forming an integral unit with the bottom 9 of the mouth piece.

The beaded area 8 is prolonged at the bottom area with decreasing thickness away from the urinal, thus providing a border area with a corrugated outer border 8*a*. The border is relatively thin and soft to ensure sealing contact with the patient without particularly inconveniencing the patient.

The mouthpiece is provided with a purchase, flap, tab or the like 7 to facilitate easy removal from the urinal for cleaning or exchanging purposes. Preferably, the purchase, flap, tab or the like 7 forms an integral part of the mouthpiece (2).

We claim:

1. A single, replaceable mouth piece attachment for a urinal having a mouth and facilitating use of the urinal by bedridden patients of either sex and comprising a round part provided to fit into sealing contact with the mouth of the urinal, the round part having a border area of soft, flexible material facing the patient, means forming a liquid barrier extending substantially across the round part and separating the mouth piece into two separate areas for receiving urine, one area being closed off by a floor area having a valve only permitting flow of liquid into the urinal, when the mouth piece is attached to the urinal, the thickness of the border area decreasing in a direction away from the urinal and the outer border of at least a portion of the border area being corrugated.

2. A mouth piece for attachment to a urinal according to claim 1, wherein the mouth piece is provided with a means facilitating removal of the mouth piece from the urinal.

3. A mouth piece for attachment to a urinal according to claim 2, wherein the mouth piece is formed as an integral unit made of plastics.

4. A mouth piece for attachment to a urinal according to claim 3 wherein the border area comprises an outwardly projecting, round beaded area for sealingly contacting an outwardly projecting, round rim of the urinal.

5. A mouth piece for attachment to a urinal according to claim 1, wherein the mouth piece is formed as an integral unit made of plastics.

6. A mouth piece for attachment to a urinal according to claim 5 wherein the border area comprises an outwardly projecting, round beaded area for sealingly contacting an outwardly projecting, round rim of the urinal.

* * * * *